US007277026B2

(12) United States Patent
Hall et al.

(10) Patent No.: US 7,277,026 B2
(45) Date of Patent: Oct. 2, 2007

(54) DOWNHOLE COMPONENT WITH MULTIPLE TRANSMISSION ELEMENTS

(76) Inventors: David R. Hall, 2185 S. Larsen Pkwy., Provo, UT (US) 84606; David Bartholomew, 2185 S. Larson Pkwy., Provo, UT (US) 84606; Joe Fox, 2185 S. Larson Pkwy., Provo, UT (US) 84606

( * ) Notice: Subject to any disclaimer, the term of this patent is extended or adjusted under 35 U.S.C. 154(b) by 304 days.

(21) Appl. No.: 11/133,905

(22) Filed: May 21, 2005

(65) Prior Publication Data

US 2006/0260797 A1 Nov. 23, 2006

(51) Int. Cl.
*G01V 1/047* (2006.01)

(52) U.S. Cl. ..... 340/854.8; 367/82; 340/854.9

(58) Field of Classification Search ..... 340/854.9, 340/855.1, 854.6, 854.4, 853.1; 336/132, 336/214; 166/242.6, 66.5; 367/82
See application file for complete search history.

(56) References Cited

U.S. PATENT DOCUMENTS 7,168,510 B2 * 1/2007 Boyle et al. ..... 175/107

* cited by examiner

*Primary Examiner*—Brian Zimmerman
*Assistant Examiner*—Hung Q Dang
(74) *Attorney, Agent, or Firm*—Tyson J. Wilde; Johnathan Barlow

(57) ABSTRACT

A tubular component in a downhole tool string has a first end and a second end. The first end includes first and second inductive couplers, and the second end includes third and fourth inductive couplers. The component further has a first conductive medium and second conductive medium. The first conductive medium is connecting the first and third couplers, and the second conductive medium is connecting the second and fourth couplers. The first and second ends may include additional inductive couplers and the component may include an additional conductive medium connecting the additional couplers. A tubular component in a downhole tool string may have a first end and a second end and electronic equipment disposed in the component. The first end may have a first plurality of inductive couplers, and the component may further have a conductive medium connecting each inductive coupler of the first plurality of inductive couplers and the electronic equipment.

16 Claims, 16 Drawing Sheets

DOWNHOLE COMPONENT WITH MULTIPLE TRANSMISSION ELEMENTS

BACKGROUND OF THE INVENTION

The present invention relates to the field of communication in a downhole environment, particularly in a downhole network integrated into a drill string used in oil and gas exploration, or along the casings and other equipment used in oil and gas production. Gathering information of the actual operation of a drill string and the geological formations surrounding a well bore may assist drilling operations. Many systems have been disclosed which transmit information along a tool string, and these systems may be referred to in separate categories.

A first category includes references which employ direct electrical contacts between pipes. An example of such a system is U.S. Pat. No. 4,953,636 which is herein incorporated by reference for all that it discloses. The '636 patent discloses a pipe assembly for use in production or drilling systems. The pipe assembly comprises a plurality of pipe members connected together in end-to-end relationship and a plurality of tubular conductor members electrically connected together in end-to-end relationship. Other examples of such systems are disclosed in the following U.S. Pat. Nos. 6,296,066, 6,688,396; which are both incorporated by reference herein for all that they disclose.

A second category includes references which employ optical fibers and fiber optic couplers between pipes. An example of such a system is U.S. Pat. No. 6,734,805 which is herein incorporated by reference for all that it discloses. The '805 patent discloses a section of pipe for well operations which has a cylindrical fiber composite pipe body and a pair of metallic end fittings. Each pipe is also provided with an optical fiber for data transmission, and a fiber optic coupling is located at each end of the optical fiber for sending and receiving data transmissions via optical signals. Also disclosed is replacing the optical fiber with an electrical conductor, and the fiber optic coupling with electrical connectors and/or contacts.

A third category includes those references which employ inductive couplers between pipes. The term "inductive coupler" is herein intended to refer to a loop or loops of one or more wires and a path through the loop(s) through which inductive flux may flow. Generally an inductive coupler may transfer magnetic energy to another inductive coupler through mutual inductance between the two inductive couplers. The amount of magnetic energy transferred may be affected by the number of loops, the number of wires, magnetic permeability of material in the path through the loops, or proximity and orientation of one coupler to another. An example of a system which employs inductive couplers is U.S. Pat. No. 6,641,434 which is herein incorporated by reference for all that it discloses. The '434 patent discloses a wired pipe joint including a first annular coil fixedly mounted to a box-end, and a second annular coil fixedly mounted to a pin-end. The '434 patent also discloses a redundant system of two pairs (or more) of wires which could be run from end to end on each joint and two independent coil windings could be wound in each coupler, so that a single broken wire would not cause a system failure. Other examples of such systems are disclosed in the following U.S. Pat. No. 6,670,880 ('880 patent) and U.S. Pat. No. 6,866,306 which are herein incorporated by reference for all that they disclose.

BRIEF SUMMARY OF THE INVENTION

A tubular component in a downhole tool string comprises a first end and a second end. The first end comprises first and second inductive couplers, and the second end comprises third and fourth inductive couplers. The component further comprises a first conductive medium and second conductive medium. The first conductive medium connects the first and third couplers, and the second conductive medium connects the second and fourth couplers.

The component may be selected from the group consisting of rigid pipes, coiled tubing, jars, mud hammers, motors, seismic tools, swivels, well casing, bottom-hole assemblies, shock absorbers, reamers, under-reamers, saver subs, steering elements, production pipes, and combinations thereof.

The terms "shoulder" is herein intended to refer to a portion of an end designed to carry weight and stress and which is designed to butt against a corresponding shoulder of another component. The ends of the component may have one or more shoulders. The first and second inductive couplers may be located in a secondary shoulder of the first end and the third and fourth inductive couplers may be located in a secondary shoulder of the second end. Alternatively, the first inductive coupler may be located in a primary shoulder of the first end, the second inductive coupler may be located in a secondary shoulder of the first end, the third inductive coupler may be located in a primary shoulder of the second end and the fourth inductive coupler may be located in a secondary shoulder of the second end.

The inductive couplers may comprise a coil disposed in a trough of magnetically conductive material. The magnetically conductive material may comprise a composition selected from the group consisting of ferrite, Ni, Fe, Cu, Mo, Mn, Co, Cr, V, C, Si, mu-metals, alloys, molypermalloys, metallic powder suspended in an electrically insulating material, and combinations thereof. The coils of the first and second inductive couplers may be disposed in a trident-shaped magnetically conducting material, and the coils of the third and fourth inductive couplers may be disposed in a trident-shaped magnetically conducting material.

The first and second conductive mediums may be selected from the group consisting of coaxial cables, shielded coaxial cables, twisted pair cables, triaxial cables, and biaxial cables. The component may further comprise electronic equipment disposed in the component. The electronic equipment may be selected from the group consisting of network nodes, repeaters, downhole tools, computers, modems, network interface modems, processors, memories, bottom-hole assemblies, seismic sources, seismic receivers, wireless transceivers, motors, turbines, amplifiers, MWD tools, LWD tools, sensors, pressure sensors, temperature sensors, pumps, perforators, other tools with an explosive charge, mud-pulse sirens, switches, routers, multiplexers, piezoelectric devices, magnetostrictive devices, optical transmitters, optical regenerators, optical receivers, optical converters and combinations thereof.

The first end of the component may be adapted to connect to a second end of a similar component, and the first and second inductive couplers of the component may be aligned with and proximate fifth and sixth inductive couplers of the similar component, respectively, when the components are connected.

The first inductive coupler, the third inductive coupler, and the first conductive medium may be electromagnetically independent from the second inductive coupler, the fourth inductive coupler, and the second conductive medium. The term "electromagnetically independent" is herein intended to refer to the ability to transmit electromagnetic signals which are distinguishable from other electromagnetic signals. A first path may be electromagnetically independent from a second path if signals transmitted along the first path are distinguishable from signals transmitted along the second path, although some interference or noise may exist between the first and second path.

The first end may further comprise a seventh inductive coupler, the second end may further comprise an eighth inductive coupler, and the component may further comprise a third conductive medium connecting the seventh and eighth inductive couplers. The seventh inductive coupler may be located in a tertiary shoulder of the first end and the eighth inductive coupler may be located in a tertiary shoulder of the second end. The inductive couplers may be capable of transmitting power.

Also disclosed is a component which comprises electronic equipment. The first end comprises a first plurality of inductive couplers and a conductive medium connecting each inductive coupler to the electronic equipment.

The component may comprise a ninth inductive coupler in the second end and a fourth conductive medium intermediate the inductive coupler and the electronic equipment. The first end may comprise more inductive couplers than the second end.

In one embodiment of the present invention, a downhole tool string comprises a plurality of components. Each component comprises a first end, a second end, and a data conductive medium intermediate and in communication with data couplers proximate the first and second ends. The tool string further comprises a power transmission path integrated into at least a portion of the tool string and electrically independent of the data conductive medium. The data couplers may be selected from the group consisting of inductive couplers, acoustic couplers, optic couplers, and direct contact couplers. The power transmission path may comprise a segmented medium joined by couplers selected from inductive couplers and direct contact couplers. Power may be generated downhole or on the surface and the power transmission path may connect downhole tools.

The terms "pin-end" and "box-end" are herein intended to refer to ends of a pipe which are designed to mate together. Generally speaking, a pin-end is intended to be inserted into a box-end.

DETAILED DESCRIPTION OF THE INVENTION AND THE PREFERRED EMBODIMENT

Figure 1:
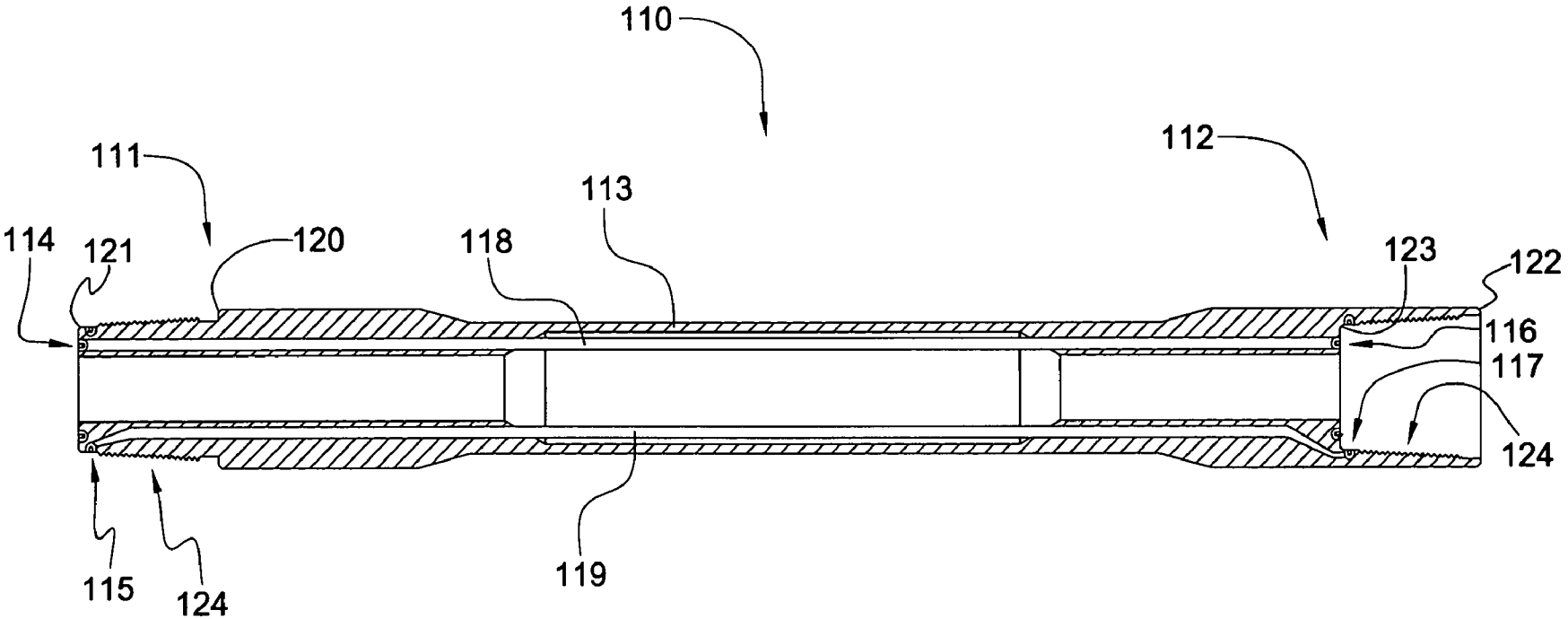
FIG. 1 is a cross sectional diagram of a tool string component.

FIG. 1 is a cross sectional diagram of a tubular component 110 comprising a tubular body 113, a first end 111 and a second end 112. The first end 111 comprises first second and inductive couplers 114, 115, and the second end 112 comprises third and fourth inductive couplers 116, 117. The component 110 in FIG. 1 is a rigid pipe, although other embodiments of the component 110 may be selected from the group consisting of coiled tubing, jars, mud hammers, motors, seismic tools, swivels, well casing, bottom-hole assemblies, shock absorbers, reamers, under-reamers, saver subs, steering elements, and production pipes, and combinations thereof.

Still referring to FIG. 1, the first end 111 comprises a first primary shoulder 120 and a first secondary shoulder 121, and the second end 112 also comprises a second primary shoulder 122 and a second secondary shoulder 123.

The first and second inductive couplers 114, 115 may be located in a secondary shoulder 121 of the first end 111 and the third and fourth inductive couplers 116, 117 may be located in a secondary shoulder 123 of the second end 112. Alternatively, the first inductive coupler 114 may be located in a primary shoulder 120 of the first end 111, the second inductive coupler 115 may be located in a secondary shoulder 121 of the first end 111, the third inductive coupler 116 may be located in a primary shoulder 122 of the second end 112 and the fourth inductive coupler 117 may be located in a secondary shoulder 123 of the second end 112. It may be advantageous to place the couplers 114, 115, 116, 117 in the shoulders 120, 121, 122, 123 of the component 110 as the shoulders 120, 121, 122, 123 may be flat and the couplers 114, 115, 116, 117 may therefore be brought close to couplers in an adjacent component (not shown) to improve transmission between the couplers 114, 115, 116, 117 and the adjacent component. Furthermore, the component may comprise threads 124 in one or more ends, and couplers 114, 115, 116, 117 disposed among the threads 124 may weaken the threads 124.

The component 110 further comprises first and second conductive mediums 118, 119. The first conductive medium 118 connects the first and third inductive couplers 114, 116 and the second conductive medium 119 connects the second and fourth inductive couplers 115, 117. The first and second conductive mediums 118, 119 may be selected from the group consisting of coaxial cables, shielded coaxial cables, twisted pair cables, triaxial cables, and biaxial cables. The first inductive coupler 114, the third inductive coupler 116, and the first conductive medium 118 are electromagnetically independent from the second inductive coupler 115, the fourth inductive coupler 117, and the second conductive medium 119. This may be advantageous as independent signals may be transmitted along the conductive mediums 118, 119. A second conductive medium 119 may provide additional bandwidth over a system which only has one conductive medium. One or both of the conductive mediums 118, 119 may be used to transmit power and inductive couplers 114, 115, 116, and/or 117 may transmit power between adjacent components 110. This may be advantageous as it may provide power to downhole tools (not shown), as well as communication between components 110. For example, the first conductive medium 118 may be a data conductive medium, and the second conductive medium 119 may be a power conductive medium. The power may be generated downhole or on the surface and the second transmission 119 path may connect downhole tools (not shown). The second conductive medium 119 may be electrically independent of the first conductive medium 118.

Alternatively, a separate power transmission path (not shown) may be included in components 110, 210. The power transmission path may be a direct contact transmission path such as the system described in U.S. application Ser. No. 10/605,493 filed Oct. 2, 2003 in the name of Hall, et. al, which is herein incorporated by reference for all that it discloses.

Figure 2:
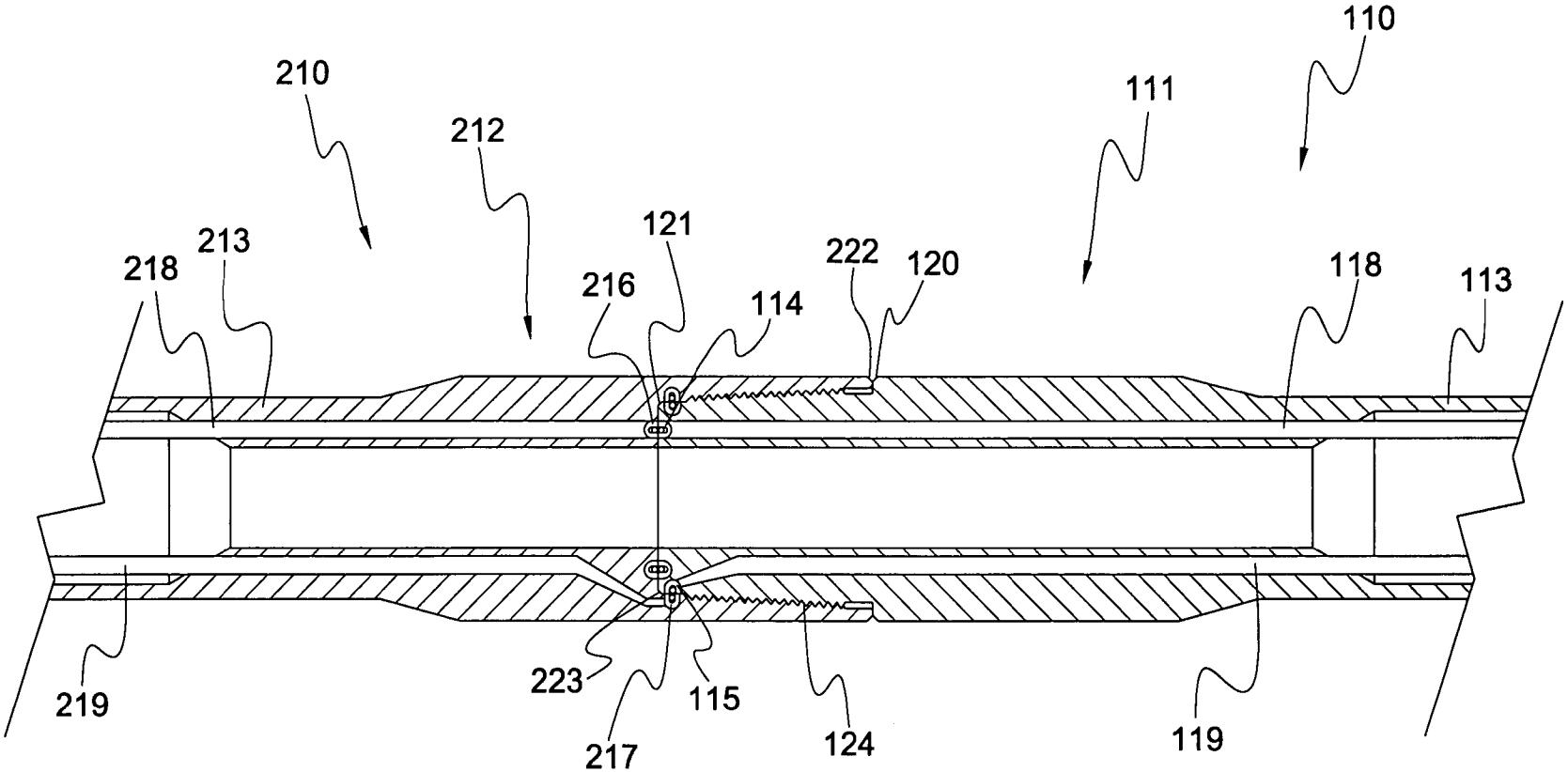
FIG. 2 is a cross sectional view of a component connected to an adjacent component.

Referring now to FIG. 2, the first end 111 of component 110 may be adapted to connect to a second end 212 of an adjacent component 210. The first end 111 of the component 110 may comprise threads 124 which are complementary to threads 124 in the second end 212 of the adjacent component 210, to provide a threaded connection. The adjacent component 210 may have a fifth inductive coupler 216 connected to a fifth conductive medium 218 and a sixth inductive coupler 217 connected to a sixth conductive medium 219 in adjacent component 210. The fifth and sixth conductive mediums 218, 219 may be disposed in the body 213 of the adjacent component 210. The primary and secondary shoulders 222, 223 of the adjacent component 210 may be adapted to abut against the primary and secondary shoulders 120, 121 of the component 110. The secondary shoulder 121 abutting against adjacent secondary shoulder 223 of adjacent tool string component 210 and may provide addition strength to the tool string.

First and second inductive couplers 114, 115 of the component may be aligned with and proximate fifth and sixth inductive couplers 216, 217 of the adjacent component 210, respectively, when the components 110, 210 are connected. The couplers 114, 115, 216, 217 may allow power and/or signals on the conductive mediums 218, 219 of the adjacent component 210 to be inductively coupled to conductive mediums 118, 119 in the body 113 of the component 110, thus allowing communication and power transfer across the joint.

Figure 3:
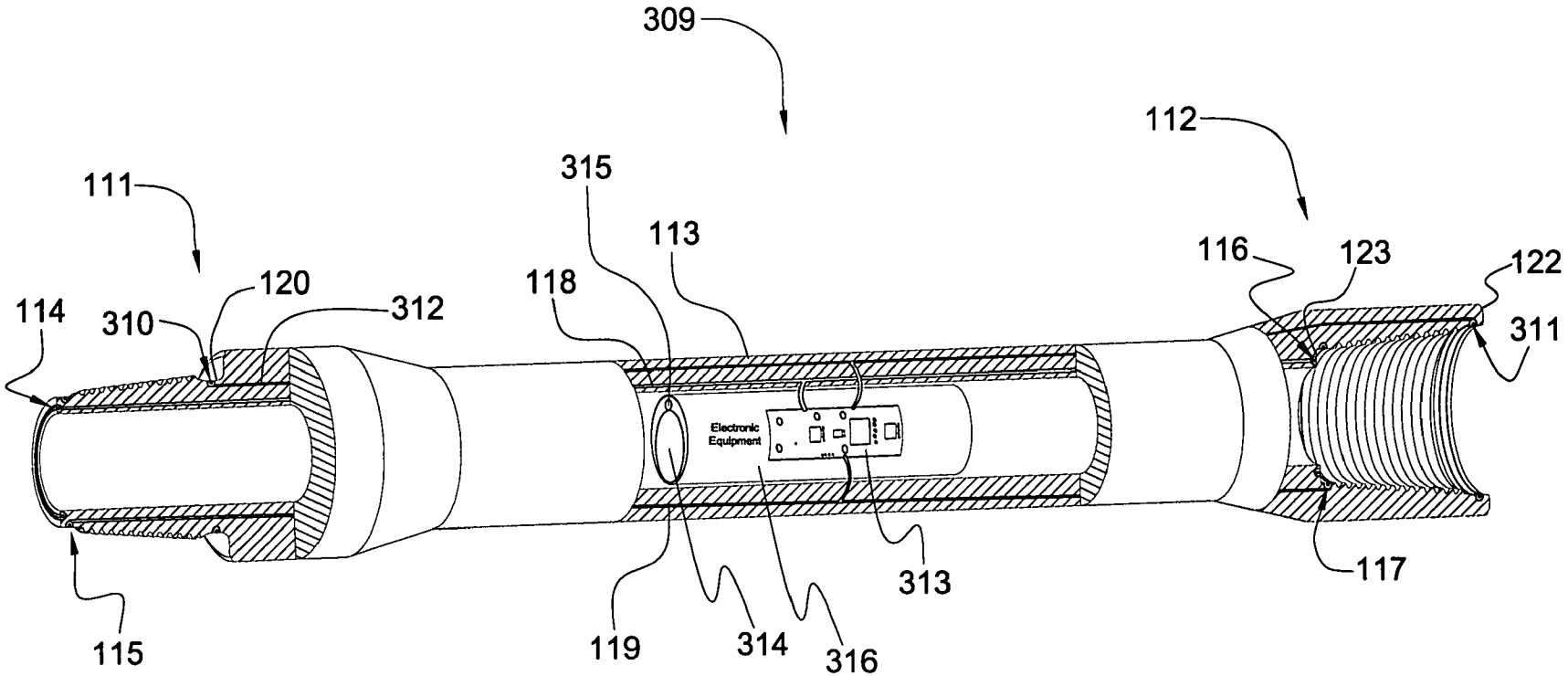
FIG. 3 is a cross sectional diagram of electronic equipment disposed within a component.

FIG. 3 is a cross sectional diagram of a tubular component 309 similar to the component 110 shown in FIG. 1 having first and second inductive couplers 114, 115 in a first end 111, third and fourth inductive coupler 116, 117 in a second end 112, and first and second conductive mediums 118, 119 in a body 113 of the component 309 as previously discussed. The first end 111 of the component 309 may further comprise a seventh inductive coupler 310, the second end 112 may further comprise an eighth inductive coupler 311, and the component 309 may further comprise a third conductive medium 312 connecting the seventh 310 and eighth 311 inductive couplers. The component 309 may comprise electronic equipment 313 disposed in the component 309, and the electronic equipment 313 may be selected from the group consisting of network nodes, repeaters, downhole tools, computers, modems, network interface modems, processors, memories, bottom-hole assemblies, seismic sources, seismic receivers, wireless transceivers, motors, turbines, generators, amplifiers, MWD tools, LWD tools, sensors, pumps, perforators, other tools with an explosive charge, mud-pulse sirens, switches, routers, multiplexers, piezoelectric devices, magnetostrictive devices, optical transmitters, optical regenerators, optical receivers, optical converters and combinations thereof. The electronic equipment 313 may be in communication with the conductive mediums 118, 119, 312. Drilling fluid may flow through a tubular opening 314 in the housing 316 of the electronic equipment 313. The electronic equipment 313 may comprise a generator and an opening 315 may divert a portion of the drilling fluid to run the generator. A generator which may be used in conjunction with the present invention is disclosed in U.S. patent application Ser. No. 10/982,612 filed Nov. 5, 2004 in the name of Hall, et. al. which is herein incorporated by reference for all that it discloses. A generator may provide a source of power downhole which may be transmitted between components 309, 210, 110 as previously discussed.

An example of electronic equipment 313 disposed in the component 309 may be a network node which may communicate with other network nodes through the conductive mediums 118, 119, 312.

The electronic equipment 313 disposed in the component may comprise a sensor which communicates with other devices through the conductive mediums 118, 119, 312. The sensor may sense temperature, pressure, conductivity of drilling mud, or other measurable downhole characteristics.

Figure 4A:
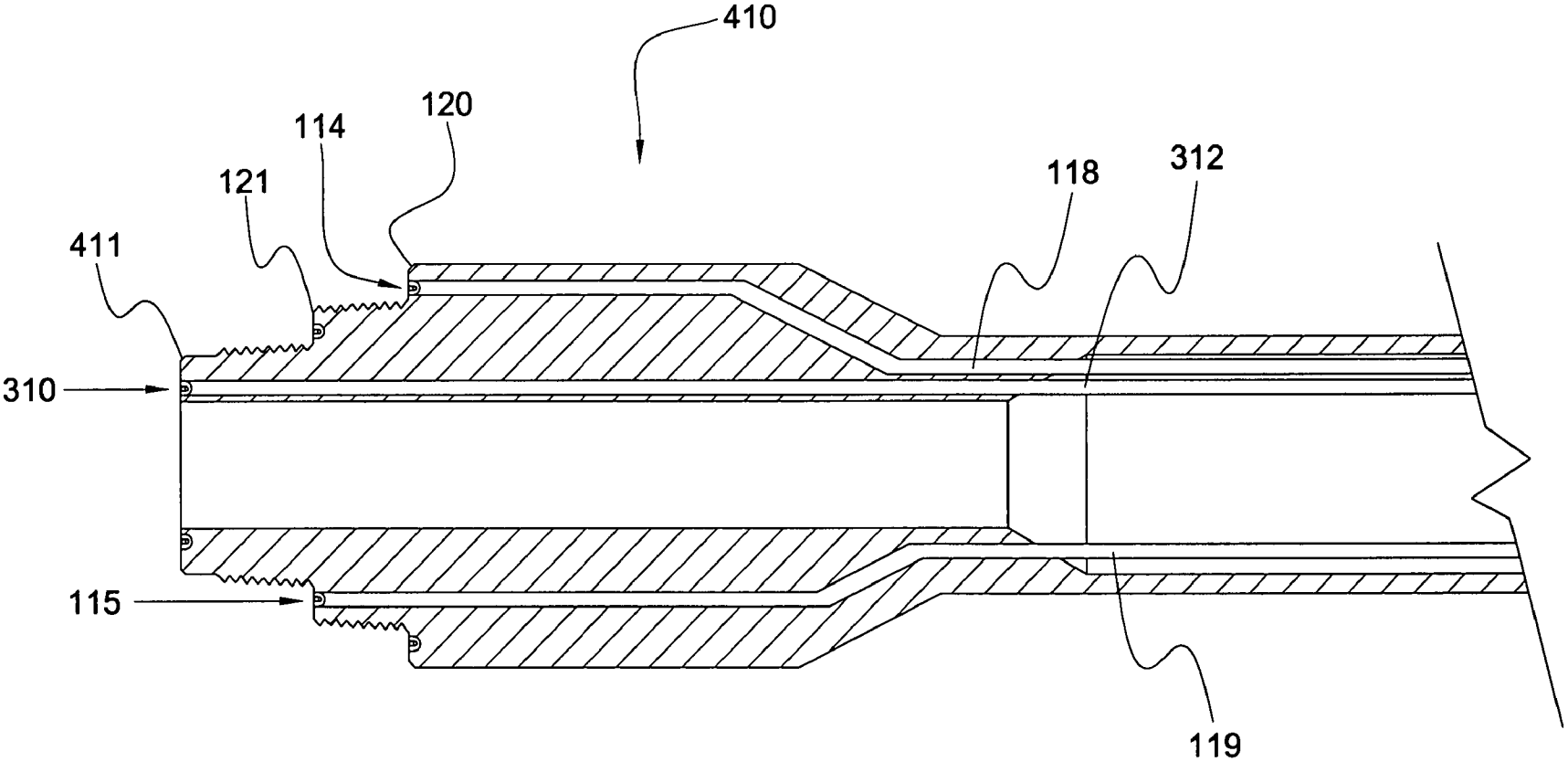
FIG. 4*a* is a cross sectional view of an end of a component having three shoulders.

The seventh inductive coupler 310 may be in a primary shoulder 120 of the first end 111, and the eighth inductive coupler 311 may be in a primary shoulder 122 of the second end 112. Alternatively, the seventh inductive coupler 310 may be in a tertiary shoulder 411 as illustrated in FIG. 4*a*. The component 410 may have first, second, and seventh couplers 114, 115, 310 in primary, secondary, and tertiary shoulders 120, 121, 411 and connected to first, second and third conductive mediums 118, 119, 312, respectively. It may be advantageous to distribute the couplers 114, 115, 312 among various shoulders 121, 120, 411, since the couplers 114, 115, 312 may be disposed in grooves (not shown), and the grooves may affect the shoulders 121, 120, 411, if the grooves are too wide.

Figure 4B:
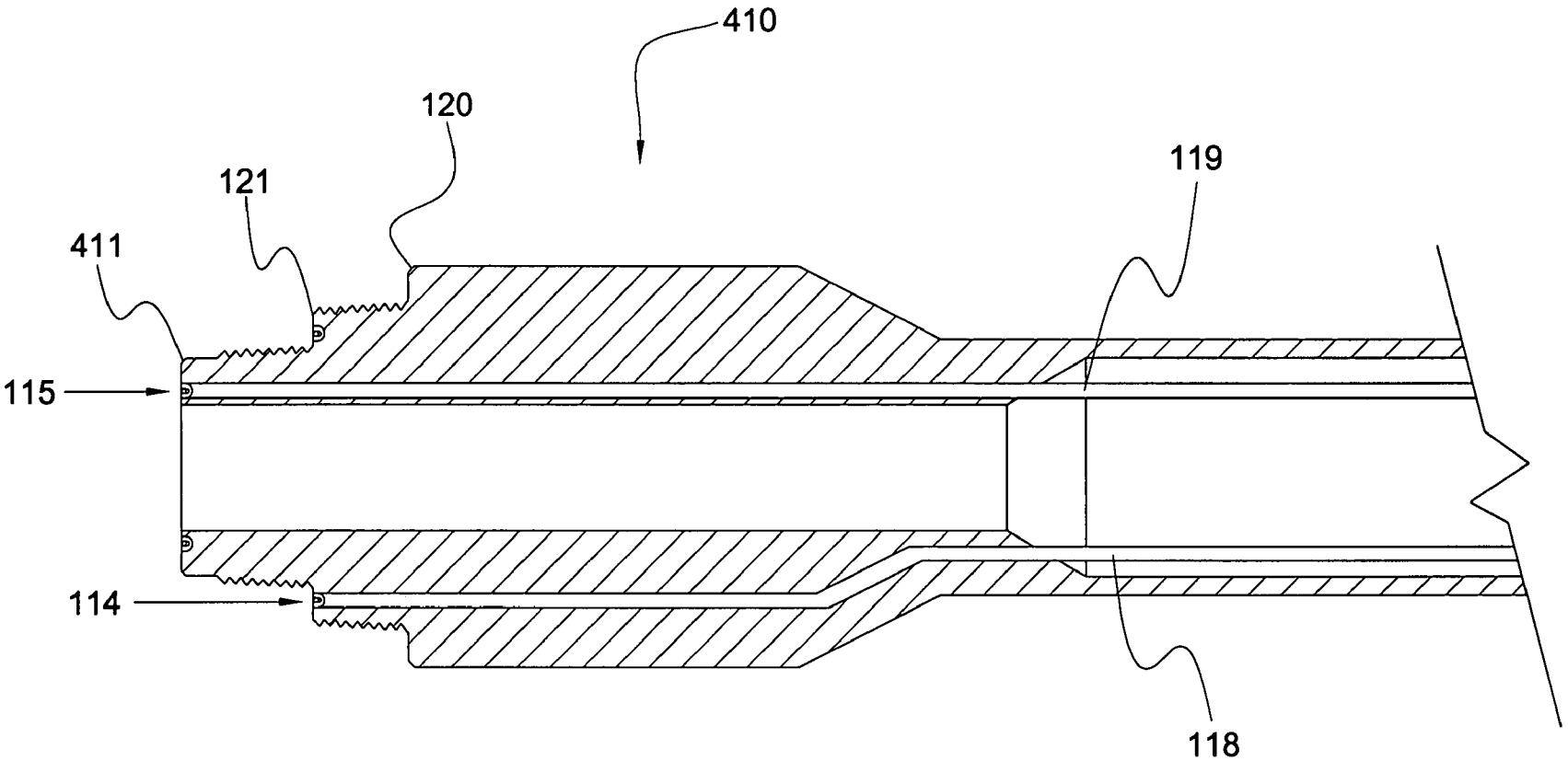
FIG. 4*b* is a cross sectional view of an end of a component having three shoulders.

FIG. 4*b* is a cross sectional view of an end of a component 410 having first and second couplers 114, 115 in secondary and tertiary shoulders 121, 411, respectively. Since the majority of stress in a downhole component may be in the primary shoulder 120, it may therefore be advantageous to have inductive couplers 114, 115 in other shoulders 121, 411.

Figure 5:
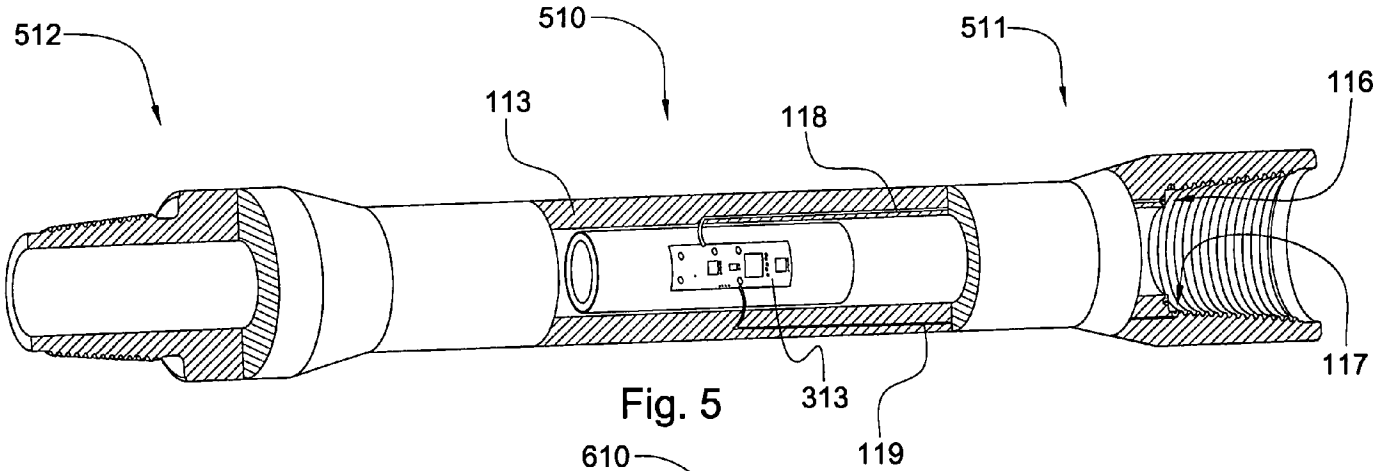
FIG. 5 is a cut away diagram of a tool string component having multiple couplers in one end.
Figure 6:
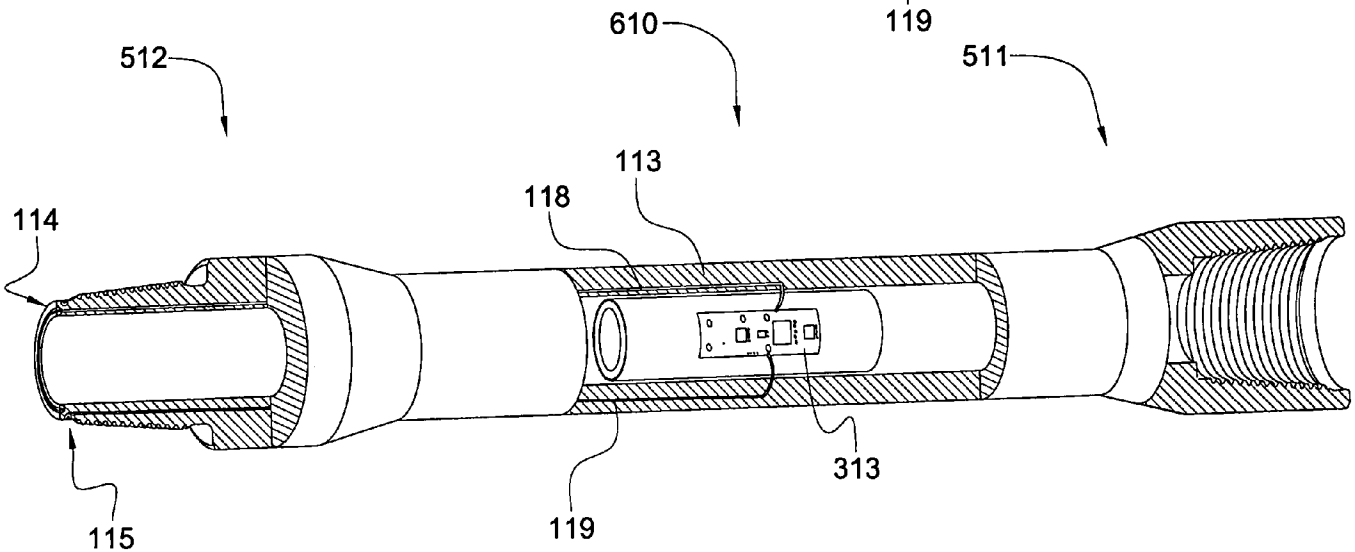
FIG. 6 is a cut away diagram of a tool string component having multiple couplers in one end.

FIG. 5 is a cut away diagram of component 510 and FIG. 6 is a cut away diagram of component 610. The components 510, 610 comprise electronic equipment 313. In FIG. 5 a box end 511 comprises a first plurality of inductive couplers 116, 117 and the component further comprises conductive mediums 118, 119 in the body 113 of the component 510 and connecting each inductive coupler to the electronic equipment 313. This may be advantageous in situations where the component 510 is at the end of a tool string where the component may need to communicate in only one direction. FIG. 6 shows a pin end 512 comprising a plurality of couplers 114, 115 connected by conductive mediums 118, 119 to the electrical equipment 313.

Figure 7:
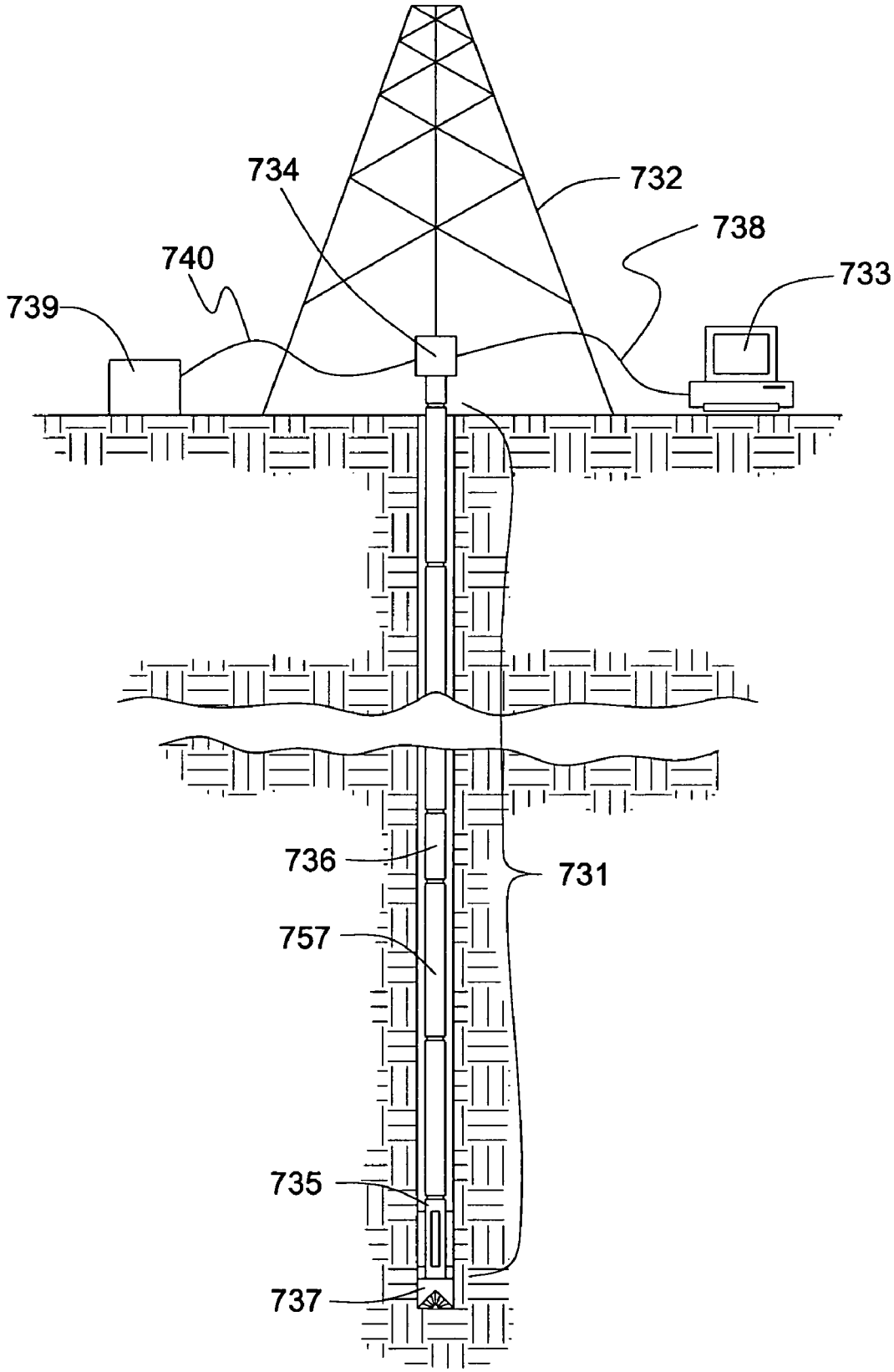
FIG. 7 is a perspective view of a drill string.

An example of a component 510, 610 at the end of a tool string may be a component 510 which is a bottom-hole assembly 735 as illustrated in FIG. 7. Pin end 512 of the component 510 may be connected to a drill bit 737, and the box end 511 may be connected to a drill string 731. The electronic equipment 313 may be inclinometers, temperature sensors, pressure sensors, or other sensors that may take readings of downhole conditions. Information gathered by the electronic equipment 313 may be communicated to the drill string by the plurality of inductive couplers 116, 117 in the box end 511.

FIG. 7 is a perspective view of a drill rig 732 and a drill string 731 which may comprise the present invention. The drill string 731 comprises a drill bit 737, a bottom-hole assembly 735, drill pipe 757, a seismic tool 736, and a swivel 734. The swivel 734 may be connected 738, 740 to surface equipment 733, 739 such as a computer 733 or a generator 739. A swivel 734 may be advantageous, as it may be an interface for data transfer from a rotating drill string 731 to stationary surface equipment 733, 739. The generator 739 may provide power to the drill string 731, and as previously discussed the downhole components 757, 736, 734 that make up the drill string 731 may be capable of transmitting power. This may be advantageous as it may provide sufficient power to the downhole components 757, 736, 734 such that batteries in each components 757, 736, 734 are not needed.

A component 610 as seen in FIG. 6 may be a swivel 734. In one embodiment the component is a swivel 734 with electronic equipment 313 comprising a router and a connection to a local area network. The connection to a local area network may be one or more wire connections and/or wireless transceivers. The local area network may be on the earth's surface and may allow communication with the internet or other networks. The router in the electronic equipment 313 may convert signals received from the local area network into signals which may be transmitted along the conductive mediums 118, 119, 312. The router in the electronic equipment 313 may also convert signals from the conductive mediums 118, 119, 312 into signals which may be transmitted along the local area network. The swivel 734 may comprise multiple connections 738 to the computer 733. Alternatively, the bandwidth of the local area network may be sufficient to transmit all the data from the swivel to the computer 733. The component 610 may therefore have inductive couplers 114, 115 in one end 111 to communicate with the drill string 731.

In an alternate embodiment the component is a swivel 734 with electronic equipment 313 comprising a combination of optical receivers, optical transmitters, and optical converters. The swivel 734 may be connected to an optical fiber network on the earth's surface which may allow high data rates. The electronic equipment 313 may convert signals received from the optical fiber network into signals which may be transmitted along the conductive mediums 118, 119, 312 and vice versa. Thus, the electronic equipment may be an interface between two kinds of networks, and may function as a router. An optical fiber network may be advantageous as the bandwidth of the optical fiber network may be sufficient to transmit all the data from the swivel to the surface equipment 733.

Figure 8:
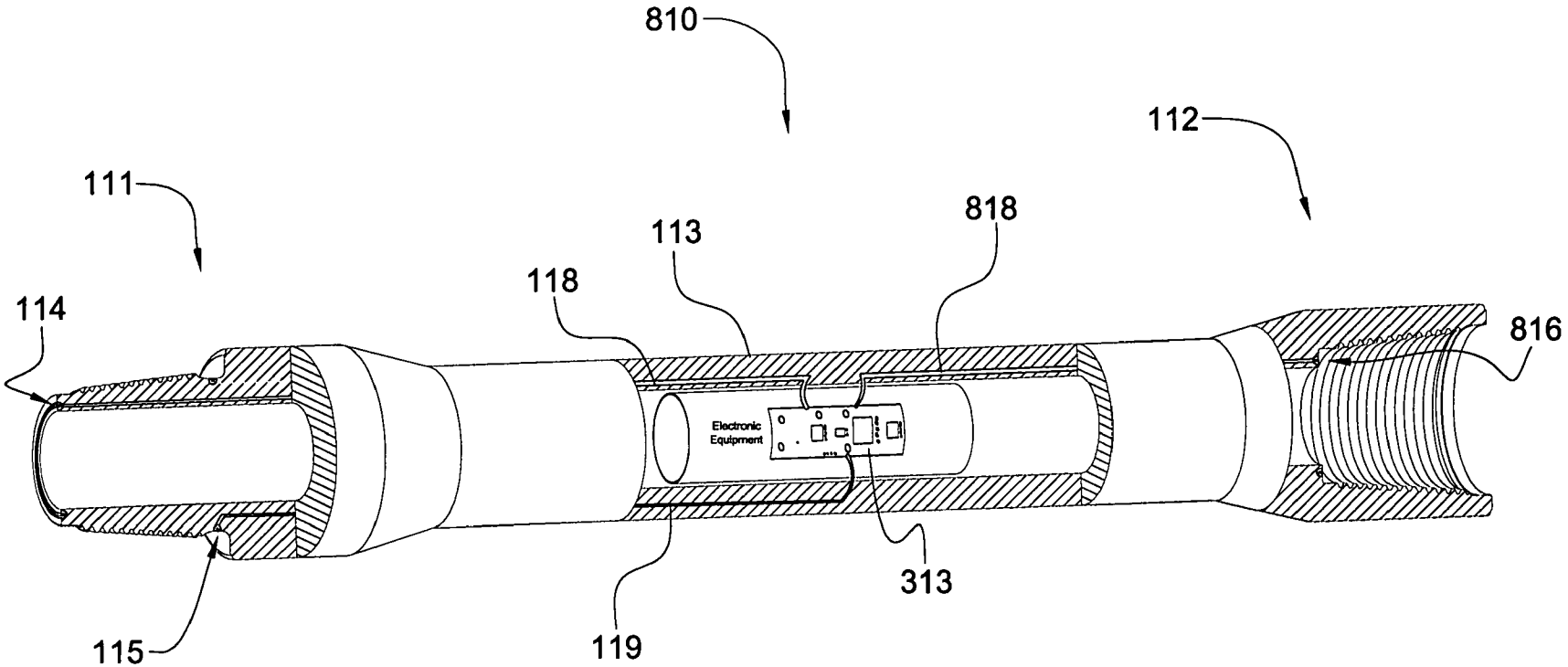
FIG. 8 is a cut away view of a tool string component having a different number of couplers in each end.

FIG. 8 is a cut away view of a tool string component 810 comprising a first end 111 comprising a first plurality of inductive couplers 114, 115 connected to electronic equipment by conductive mediums 118, 119 in body 113 of the component 810. The component 810 may further comprise a ninth inductive coupler 816 in a second end 112. A fourth conductive medium 818 may connect the ninth coupler 816 to the electronic equipment 313. Having more inductive couplers in the first end 111 than in the second end 112 may be advantageous in that it may connect components having different numbers of inductive couplers and conductive mediums.

Figure 9:
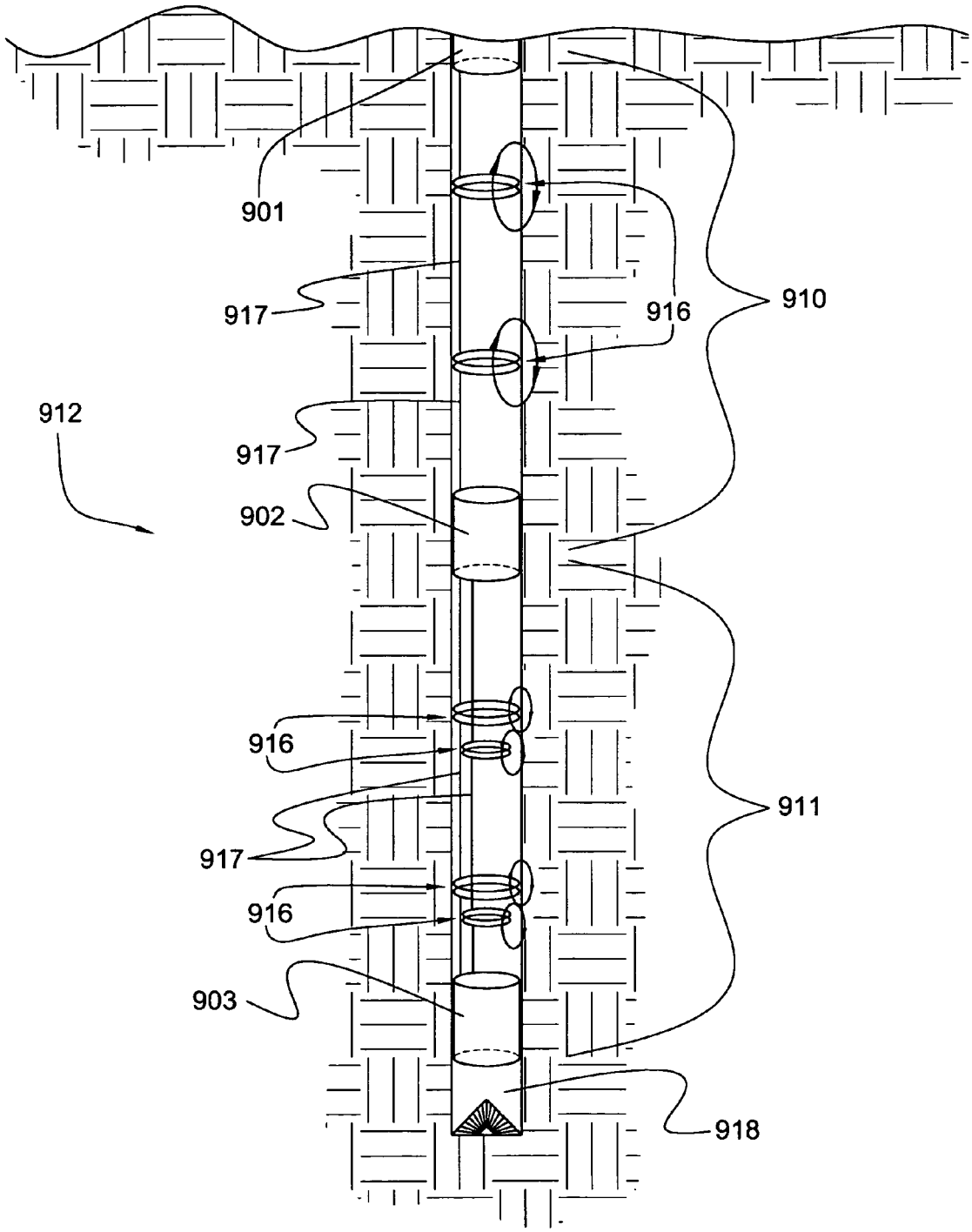
FIG. 9 is a perspective view of a downhole network.

An example of components having different numbers of inductive couplers 114, and conductive mediums may be seen in FIG. 9, which is a perspective view of a downhole network 912. A first portion 910 may have one set of inductive couplers 916 and conductive mediums 917 between first and second nodes 901, 902 and a second portion 911 may have multiple sets of inductive couplers 916 and conductive mediums 917 between second and third nodes 902, 903. The first portion 910 may comprise components having a system of inductive coils as may be seen in the '880 patent. The '880 patent discloses having one coil in each end connected by an electrical conductor. The second portion 911 may comprise components such as component 110 of FIG. 1.

Continuing with the embodiment, the component 810 of FIG. 8 may be included between the component 110 and the system of inductive coils discussed in the '880 patent. The plurality of inductive couplers 114, 115 of the component 810 (see FIG. 8) may be in communication with the third and fourth inductive couplers 116, 117 of the component 110, and the ninth inductive coupler 816 may be in communication with the system of inductive coils disclosed in the '880 patent. Electronic equipment 313 in the component 810 may be a second node 902 and may comprise a router, which may transfer information between the component 110 and the system of inductive coils discussed in the '880 patent. A second portion 911 having multiple sets of transmission elements 914, 915 may be advantageous as it may provide additional bandwidth and/or power to be transferred between second and third nodes 902, 903. Node 902 may comprise a generator which may provide power which may be transmitted to node 903.

Transmitting power to node 903 may be advantageous as node 903 may be near drill bit 918 and may comprise a bottom-hole assembly which may require additional power. Power transmitted to node 903 may supplement or replace power provided by a generator or battery in node 903. Furthermore, additional bandwidth and power transfer near the bottom of the downhole network 912 may be advantageous as the majority of tools currently in use are concentrated near the drill bit 918. These tools may therefore be powered by other nodes 902 in the network 912 and additional bandwidth may allow increased communication between tools. Furthermore, it may be advantageous to generate and transfer power near the bottom of the hole, as transmitting power over a short distance may be more efficient than transmitting power from a generator 739 (see FIG. 7) located on the surface of the earth.

Figure 10:
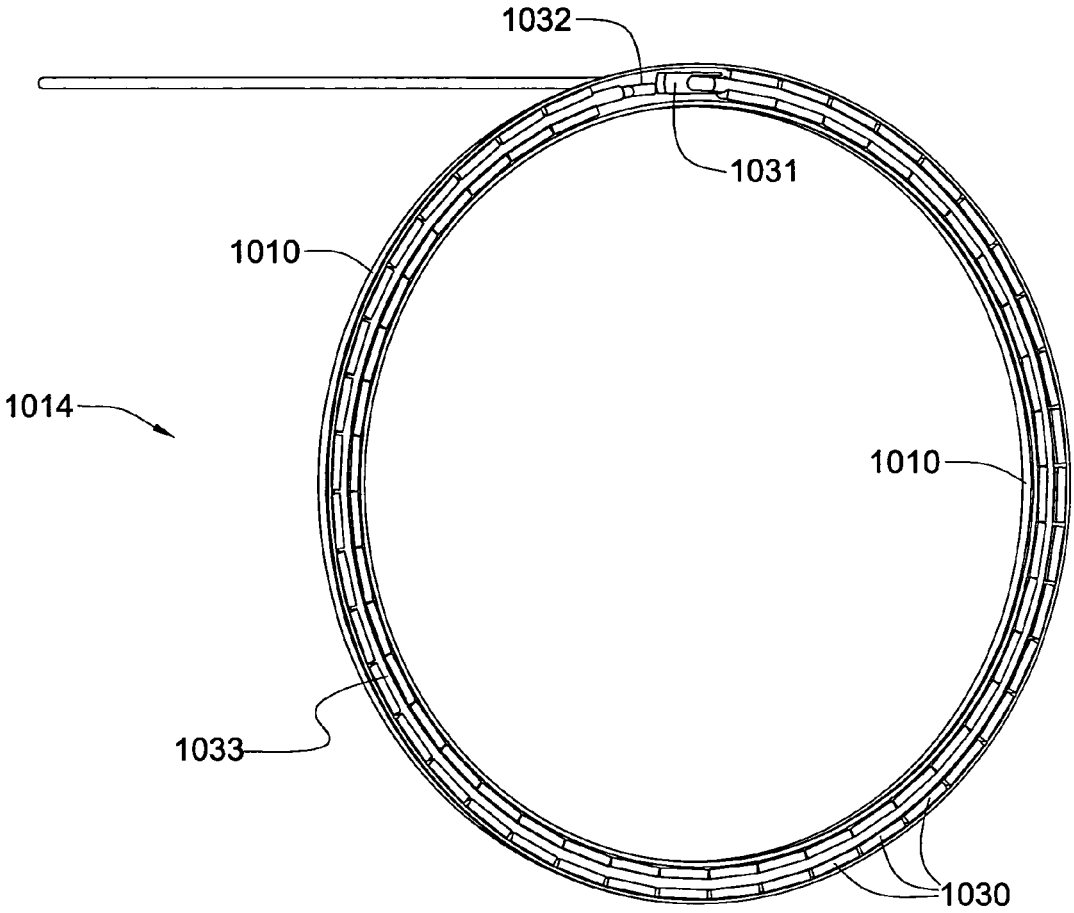
FIG. 10 is a perspective view of an inductive coupler.

FIG. 10 illustrates an example of an inductive coupler 1014 which may be used with the present invention. The coupler 1014 may comprise a coil 1033 disposed in a trough of magnetically conductive material 1030. The magnetically conductive material 1030 may comprise a composition selected from the group consisting of ferrite, Ni, Fe, Cu, Mo, Mn, Co, Cr, V, C, Si, mu-metals, alloys, molypermalloys, metallic powder suspended in an electrically insulating material, and combinations thereof. The coil 1033 and magnetically conductive material 1030 may be disposed in a ring of durable material 1010 such as steel, and the coil 1033 may pass through hole 1031 and be welded 1032 to the ring 1010.

Figure 11:
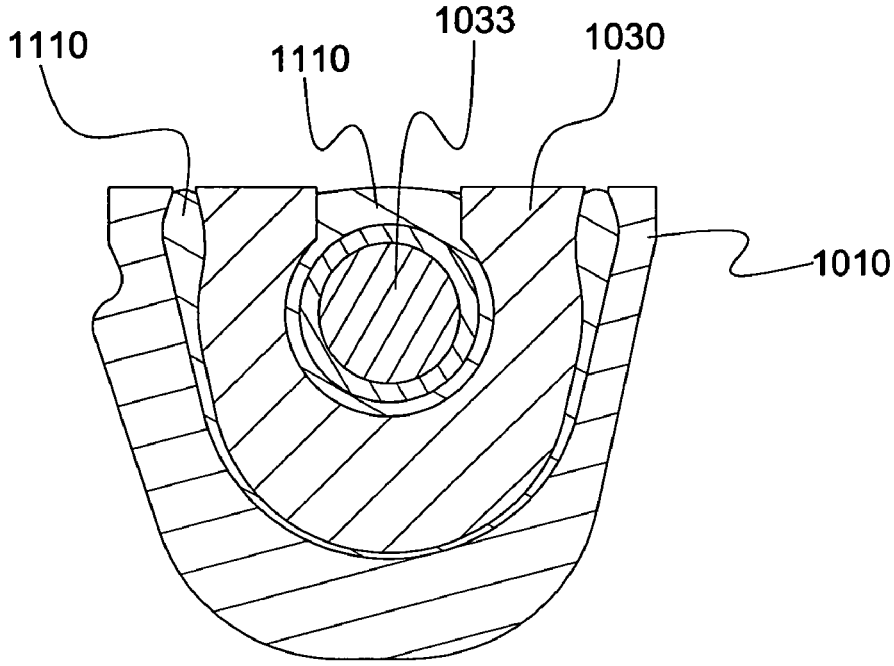
FIG. 11 is a cross-sectional view of an inductive coupler.

FIG. 11 is a cross-sectional view of an inductive coupler 1014 in FIG. 10. An electrically insulating material 1110 may separate the magnetically conducting material 1030 from the ring 1010 and from the coil 1033. This may prevent the coil 1033 from shorting to the ring or magnetically conducting material 1030. In some embodiments the magnetically conducting material 1030 is an electrically insulating material, such as ferrite.

Figure 12:
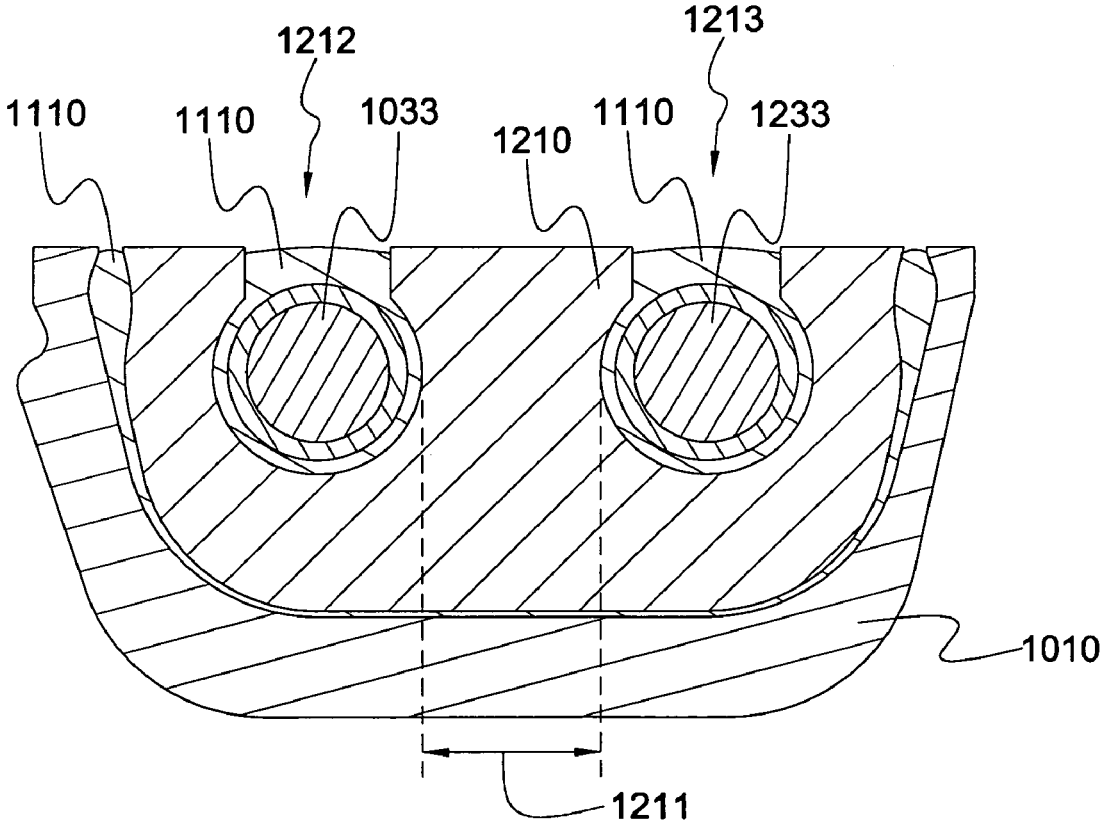
FIG. 12 is a cross section view of a pair of couplers in a magnetically conducting material.
Figure 13:
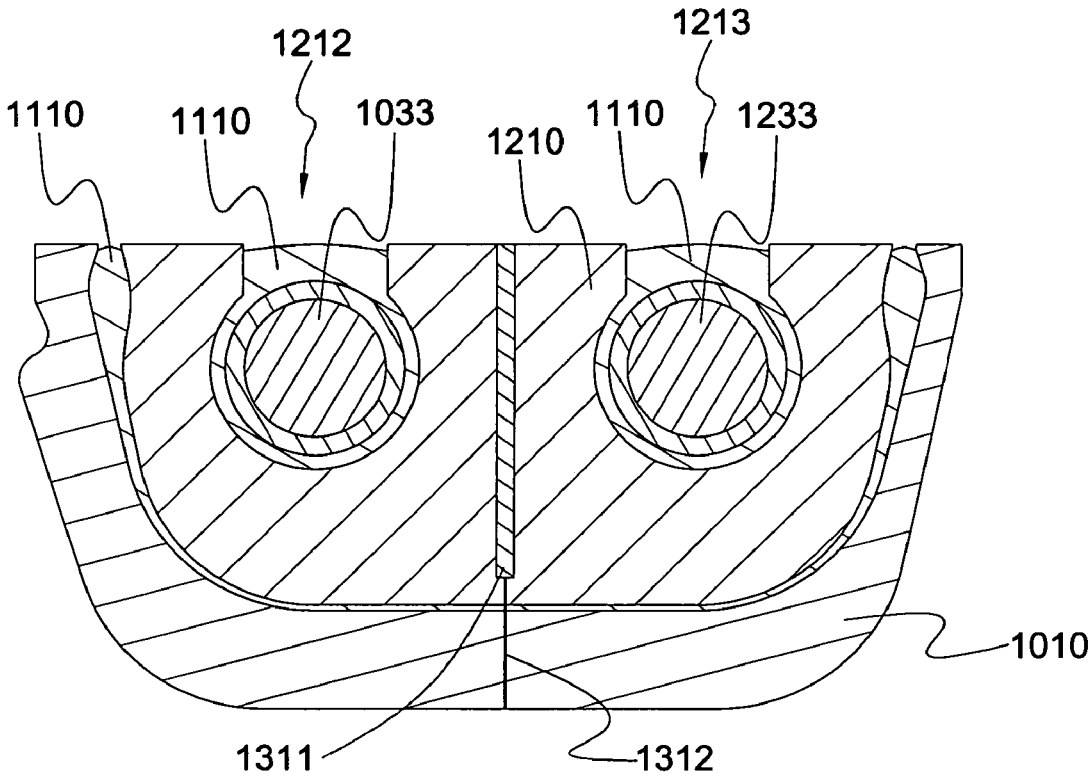
FIG. 13 is a cross section view of a pair of couplers in a magnetically conducting material separated by a magnetic shield.

FIG. 12 is a cross section view of a pair of couplers 1212, 1213 in a trident-shaped magnetically conducting material 1210. The coils 1033, 1233 may be coils of first, second third and/or fourth 114, 115, 116, 117 couplers. The couplers 1212, 1213 may be electromagnetically independent from each other if the distance 1211 between the coils 1033, 1233 is sufficient such that little or no interference occurs between coils 1033, 1233. Magnetic shielding 1311 such as steel may be disposed between the couplers 1212, 1213 to reduce electromagnetic interference as seen in FIG. 13. The magnetic shielding 1311 may be connected 1312 to the ring 1010 and thereby connected to ground.

Figure 14:
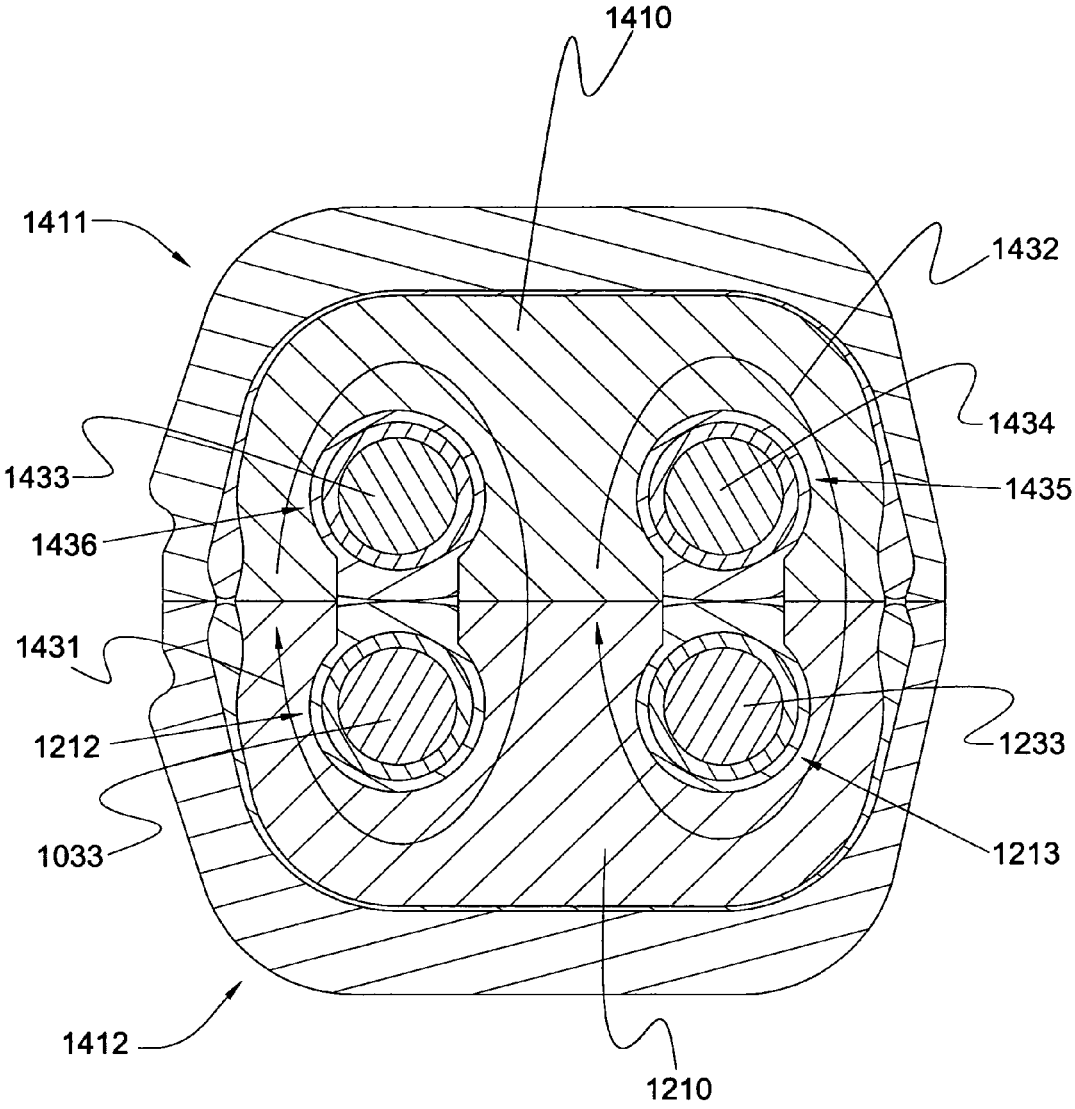
FIG. 14 is a cross section view of two mated pairs of couplers in a magnetically conducting material.

FIG. 14 is a cross section view of two mated pairs 1411, 1412 of inductive couplers 1212, 1213, 1435, 1436 in trident-shaped magnetically conducting material 1410, 1210 which may be mated to allow communication. Current flowing through coil 1233 creates a magnetic field 1432 which may be guided around coil 1434 by the magnetically conducting material 1410, 1210. The magnetic field 1432 may induce current flow in coil 1434 and thereby effect communication. Similarly, current flow through coil 1033 may create magnetic field 1431 and induce current flow in coil 1433. Although magnetic fields 1431, 1432 are shown in the same direction, it is understood that the magnetic fields 1431, 1432 generated by current flowing in the coils 1233, 1434, 1033, 1433 are dependent on the direction of the current, and that the current and the direction of the magnetic fields 1431, 1432 may be reversed. The magnetic fields 1431, 1432 may also have opposite directions.

Figure 15:
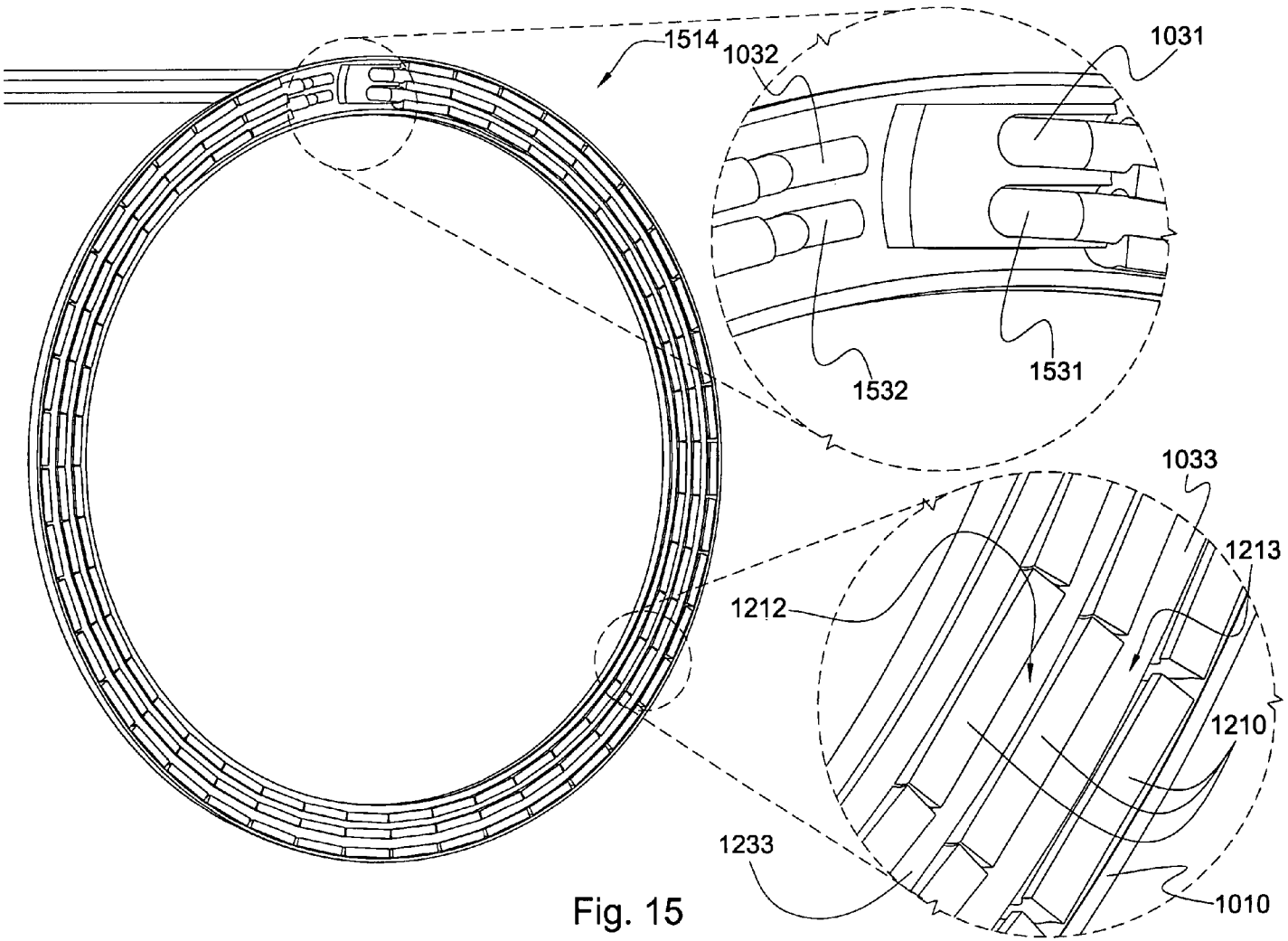
FIG. 15 is a perspective view of a pair of couplers in a magnetically conducting material.

FIG. 15 is a perspective view of a ring 1514 comprising a pair of couplers 1212, 1213 comprising coils 1033, 1233 in a magnetically conducting material 1210. The coils 1033, 1233 may be disposed in a ring of durable material 1010. Coil 1033 may pass through an opening 1031 and comprise a welded connection 1032 to the ring 1010 and coil 1233 may pass through another opening 1531 and comprise another welded connection 1532 to the ring 1010.

Figure 16B:
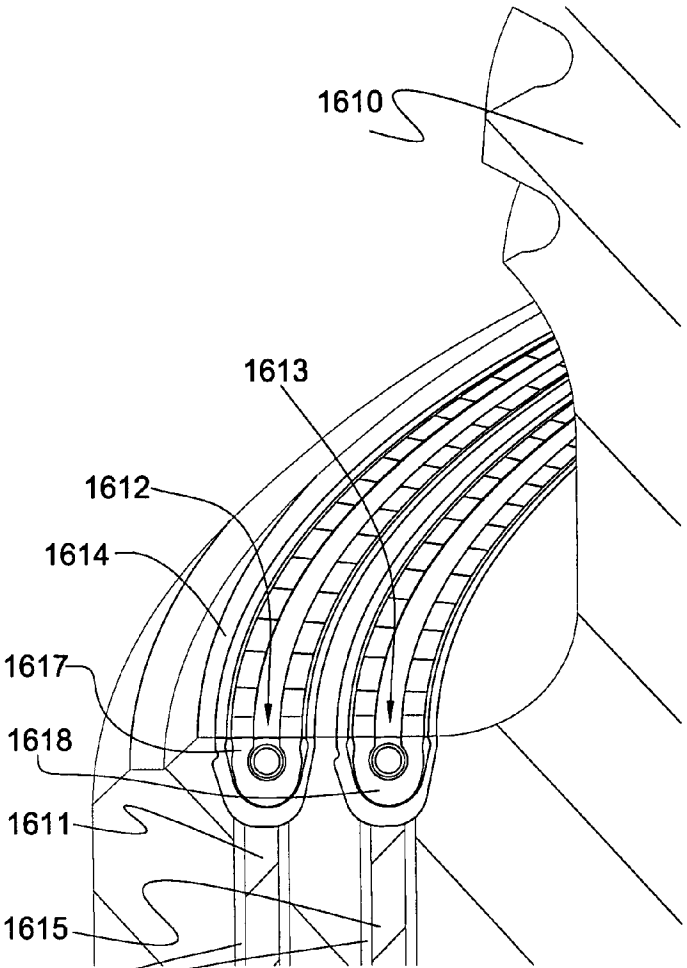
FIG. 16*b* is a cross section view of a pair of couplers in a shoulder of a component.
Figure 16A:
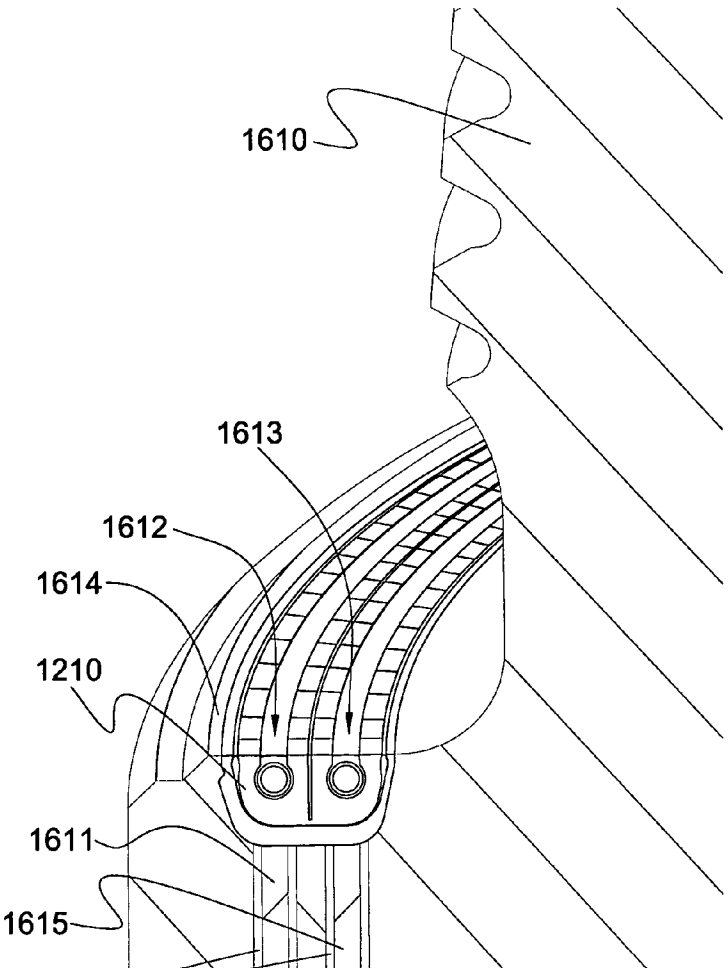
FIG. 16*a* is a cross section view of a pair of couplers in a shoulder of a component.

FIG. 16*a* and FIG. 16*b* are cross section views of a pair of couplers 1612, 1613 in a shoulder 1614 of a component 1610. As seen in FIG. 16*a*, couplers 1612, 1613 may be in a trident shaped magnetically conducting material 1210 and a conductive medium 1611, 1615 may be connected to each coupler 1612, 1613. One or more passages 1619 may be bored in the component 1610 through which the conductive mediums 1611, 1615 may pass. Couplers 1612, 1613 may be in separate troughs of magnetically conducting material 1617, 1618 as seen in FIG. 16*b*.

Figure 17:
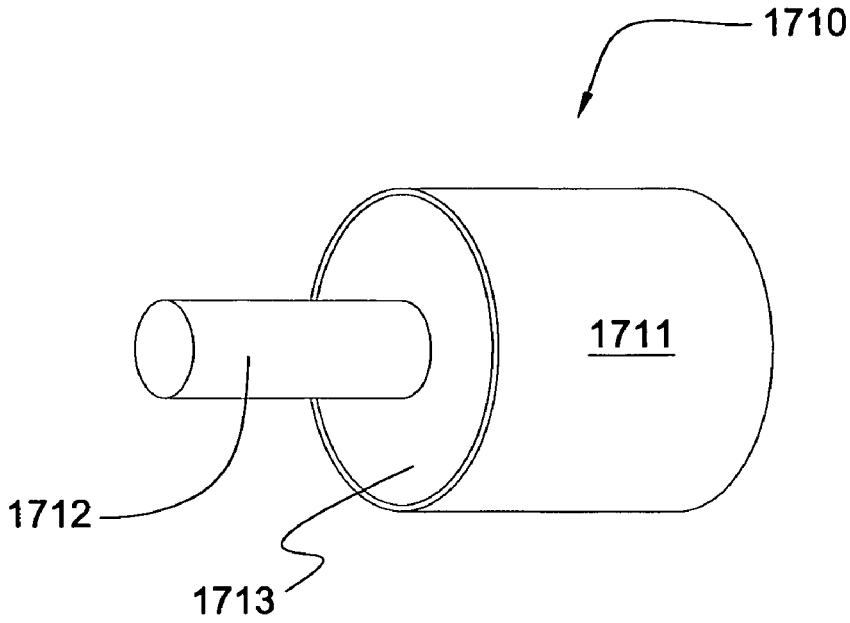
FIG. 17 is a perspective view of a coaxial cable.
Figure 18:
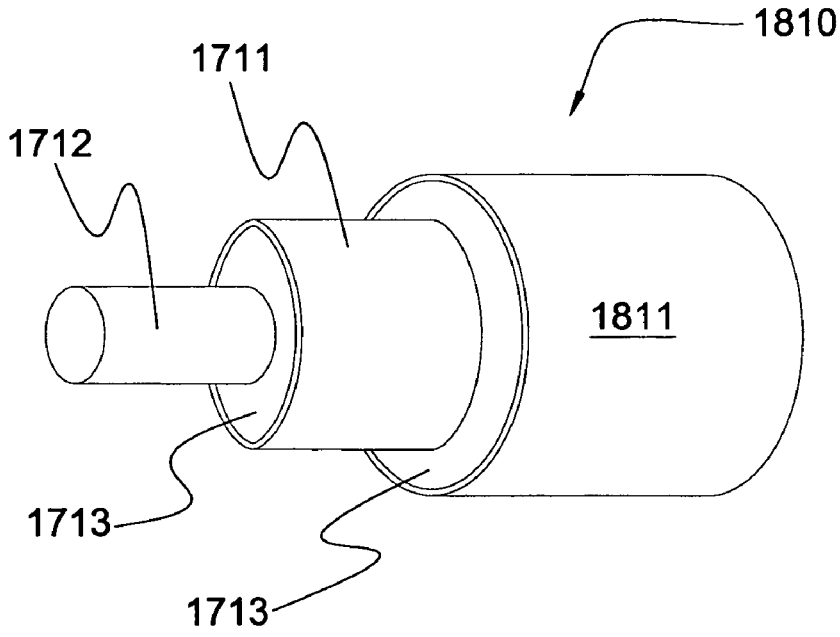
FIG. 18 is a perspective view of a shielded coaxial cable.

FIG. 17 and FIG. 18 are perspective views of conductive mediums which may be used with the present invention. FIG. 17 is a perspective view of a coaxial cable 1710 having an inner conductor 1712 separated from an outer conductor 1711 by a dielectric 1713. The inner 1712 and outer 1711 conductors may function as signal and ground conductors respectively.

FIG. 18 is a perspective view of a shielded coaxial cable 1810 also having inner conductor 1712 separated from an outer conductor 1711 by dielectric 1713. Shield 1811 surrounds the outer conductor 1711 and is separated from the outer conductor 1711 by dielectric 1713 as well. A shielded coaxial cable 1811 may be advantageous as two signals may be transmitted along one cable 1810, thereby reducing the number of passages 1613 (see FIG. 16*a* and FIG. 16*b*) which must be bored through a component 1610 (FIG. 16). For example, the inner conductor 1712 may transmit a signal, and the shield 1811 may transmit a different signal, and outer conductor 1711 may be grounded, such that little or no interference occurs between signals in the inner conductor 1712 and shield 1811.

Whereas the present invention has been described in particular relation to the drawings attached hereto, it should be understood that other and further modifications apart from those shown or suggested herein, may be made within the scope and spirit of the present invention.

What is claimed is:

1. A tubular component in a downhole tool string, comprising: a first end and a second end; the first end comprising first and second inductive couplers; the second end comprising third and fourth inductive couplers; a first conductive medium connecting the first and third couplers; and a second conductive medium connecting the second and fourth couplers, wherein the first inductive coupler, the third inductive coupler, and the first conductive medium are electromagnetically independent from the second inductive coupler, the fourth inductive coupler, and the second conductive medium.

2. The component of claim 1 wherein the first and second inductive couplers are located in a secondary shoulder of the first end and the third and fourth inductive couplers are located in a secondary shoulder of the second end.

3. The component of claim 1 wherein the first inductive coupler is located in a primary shoulder of the first end, the second inductive coupler is located in a secondary shoulder of the first end, the third inductive coupler is located in a primary shoulder of the second end and the fourth inductive coupler is located in a secondary shoulder of the second end.

4. The component of claim 1 wherein the inductive couplers comprise a coil disposed in a trough of magnetically conductive material.

5. The component of claim 4 wherein the coils of the first and second inductive couplers are disposed in a trident-shaped magnetically conducting material, and the coils of the third and fourth inductive couplers are disposed in a trident-shaped magnetically conducting material.

6. The component of claim 1 wherein the component further comprises electronic equipment disposed in the component.

7. The component of claim 6 wherein the electronic equipment is selected from the group consisting of network nodes, repeaters, downhole tools, computers, modems, network interface modems, processors, memories, bottom-hole assemblies, seismic sources, seismic receivers, wireless transceivers, motors, turbines, generators, amplifiers, MWD tools, LWD tools, sensors, pressure sensors, temperature sensors, pumps, perforators, other tools with an explosive charge, mud-pulse sirens, switches, routers, multiplexers, piezoelectric devices, magnetostrictive devices, optical transmitters, optical regenerators, optical receivers, optical converters and combinations thereof.

8. The component of claim 1 wherein the first end is adapted to connect to a second end of a similar component and the first and second inductive couplers of the component are aligned with and proximate fifth and sixth inductive couplers of the similar component, respectively.

9. The component of claim 1 wherein the first end further comprises a seventh inductive coupler, the second end further comprises an eighth inductive coupler, and the component further comprises a third conductive medium connecting the seventh and eighth inductive couplers.

10. The component of claim 9 wherein the seventh inductive coupler is located in a tertiary shoulder of the first end and the eighth inductive coupler is located in a tertiary shoulder of the second end.

11. The component of claim 1, wherein the first conductive medium transmits data and the second conductive medium transmits power.

12. A tubular component in a downhole tool string, comprising: a first end and a second end; the first end comprising first and second inductive couplers; electronic equipment disposed in the component; and first and second conductive medium connecting the first and second inductive couplers respectively to the electronic equipment; wherein the first and second inductive couplers are electrically isolated from each other.

13. The component of claim 12 wherein the component is selected from the group consisting of rigid pipes, coiled tubing, jars, mud hammers, motors, seismic tools, swivels, well casing, bottom-hole assemblies, shock absorbers, reamers, under-reamers, saver subs, production pipes, and combinations thereof.

14. The component of claim 12 wherein the electronic equipment is selected from the group consisting of network nodes, repeaters, downhole tools, computers, modems, network interface modems, processors, memories, bottom-hole assemblies, seismic sources, seismic receivers, wireless transceivers, motors, turbines, generators, amplifiers, MWD tools, LWD tools, sensors, pressure sensors, temperature sensors, pumps, perforators, other tools with an explosive charge, mud-pulse sirens, switches, routers, multiplexers, piezoelectric devices, magnetostrictive devices, optical transmitters, optical regenerators, optical receivers, optical converters and combinations thereof.

15. The apparatus of claim 14 wherein the first end comprises more inductive couplers than the second end.

16. The component of claim 12 wherein the inductive couplers are capable of transmitting power.

* * * * *